US009111713B2

(12) United States Patent
Kakutani et al.

(10) Patent No.: US 9,111,713 B2
(45) Date of Patent: Aug. 18, 2015

(54) ION SOURCE INCLUDING A FILTER ELECTRODE

(75) Inventors: Akiko Kakutani, Yokohama (JP); Kiyoshi Hashimoto, Yokohama (JP); Kiyokazu Sato, Meguro-Ku (JP); Akihiro Osanai, Yokohama (JP); Takeshi Yoshiyuki, Yokohama (JP); Tsutomu Kurusu, Meguro-Ku (JP); Kazuo Hayashi, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 14/241,303

(22) PCT Filed: Aug. 28, 2012

(86) PCT No.: PCT/JP2012/071718

§ 371 (c)(1),
(2), (4) Date: Feb. 26, 2014

(87) PCT Pub. No.: WO2013/031777

PCT Pub. Date: Mar. 7, 2013

(65) Prior Publication Data

US 2014/0225000 A1 Aug. 14, 2014

(30) Foreign Application Priority Data

Aug. 30, 2011 (JP) ..... 2011-187232

(51) Int. Cl.
*H01J 27/24* (2006.01)
*H01J 49/16* (2006.01)

(52) U.S. Cl.
CPC ..... *H01J 27/24* (2013.01); *H01J 49/164* (2013.01)

(58) Field of Classification Search
CPC ..... H01J 37/08; H01J 27/24; H01J 2237/08; H01J 27/02; H01J 37/1471; H01J 49/062; H01J 49/164; H01J 49/4215; H05H 15/00; H05H 2007/082; H05H 3/00; H05H 7/00; H05H 1/46; B01J 2219/0809; B01J 2219/0894
USPC ..... 250/423 P, 396 R, 398, 493.1, 282, 425; 313/363.1, 361.1; 315/111.21, 111.61, 315/111.81, 505–507
See application file for complete search history.

(56) References Cited

U.S. PATENT DOCUMENTS 3,406,349 A * 10/1968 Swain et al. ..... 250/423 P (Continued)

FOREIGN PATENT DOCUMENTS

| | | |
|---|---|---|
| JP | 2000-146914 A | 5/2000 |
| JP | 2003 59699 | 2/2003 |
| JP | 2007 57432 | 3/2007 |
| JP | 2009 37764 | 2/2009 |
| JP | 2012 174515 | 9/2012 |

OTHER PUBLICATIONS

Brown, "The Physics and Technology of Ion Sources," 2nd ed. Wiley-VCH, C 2004, ISBN 3527404104.*

(Continued)

*Primary Examiner* — Brooke Purinton
(74) *Attorney, Agent, or Firm* — Oblon, McClelland, Maier & Neustadt, L.L.P.

(57) ABSTRACT

Provide an ion source for outputting ion beam with high purity of polyvalent positive ion.
The ion source 10 includes: a target 12 from which electron and positive ion are generated by plasma formed by laser 13 irradiation; a first power supply source (first voltage E1) that sets an electric potential of the target 12 higher than that of a destination of the positive ion (corresponding to an acceleration channel 18 in FIG. 1); and a second power supply source (second voltage E1) that sets an electric potential of on a pass (corresponding to a filter electrode 15 in FIG. 1) from the target 12 to the destination 18 higher than that of the target 12.

3 Claims, 3 Drawing Sheets

(56) References Cited

U.S. PATENT DOCUMENTS

| | | | | |
|---|---|---|---|---|
| 3,644,731 | A * | 2/1972 | Eloy | 250/288 |
| 5,115,135 | A * | 5/1992 | Oomori et al. | 250/423 R |
| 6,744,225 | B2 * | 6/2004 | Okamura et al. | 250/423 R |
| 7,196,337 | B2 * | 3/2007 | Mikolas | 250/423 R |
| 2002/0166960 | A1 * | 11/2002 | Pronko et al. | 250/282 |
| 2002/0180365 | A1 | 12/2002 | Okamura et al. | |
| 2006/0016979 | A1 * | 1/2006 | Yang et al. | 250/288 |
| 2013/0234036 | A1 * | 9/2013 | Kakutani et al. | 250/424 |

OTHER PUBLICATIONS

Kashiwagi, H., et al., "Acceleration of high current fully stripped carbon ion beam by direct injection scheme", Review of Scientific Instruments, vol. 77, pp. 03B305-1 to 03B305-4, (2006).

International Search Report Issued Dec. 4, 2012 in PCT/JP12/071718 Filed Aug. 28, 2012.

Office Action issued Apr. 16, 2014 in German Patent Application No. 11 2012 003 609.3 (with English language translation).

* cited by examiner

ION SOURCE INCLUDING A FILTER ELECTRODE

TECHNICAL FIELD

The present invention relates to an ion source for outputting ion beam through generating plasma by laser irradiation on a target.

BACKGROUND ART

A laser utilizing ion source generates plasma through irradiating the condensed laser beam to a solid target and then evaporates and ionizes the element of the target by the laser energy. The generated plasma maintain their state and are transported to the entrance of an accelerator, where only ions are input to the accelerator by differential electric potential and then outputted as the ion beam (refer to Patent document 1, 2). While it is known that the ion acceleration of the accelerator is superior if the valence of the positive ion is higher or the mass thereof is smaller. Also the laser utilizing ion source is effective in generating a polyvalent positive ion.

CITATION LIST

Patent Literature

[Patent document 1] Japanese Patent No. 3713524
[Patent document 2] JP2009-37764A

DESCRIPTION OF THE INVENTION

Problems to be Solved by the Invention

However, the ion beam outputted from the laser utilizing ion source contains high ratio of impurities such as a cluster ion with large mass and positive ion with a low valence other than the polyvalent positive ion. For this reason, there is some problem that the linear accelerator (RFQ) is polluted by the impurities if the ion beam consisted of the low purity polyvalent ion enters into the linear accelerator.

The present invention has been made in view of such circumstances, and provides the ion source which can output ion beam with high purity of polyvalent positive ion.

DESCRIPTION OF EMBODIMENTS

First Embodiment

Hereinafter, the embodiments of the present invention will be described with reference to the accompanying drawings.

Figure 1:
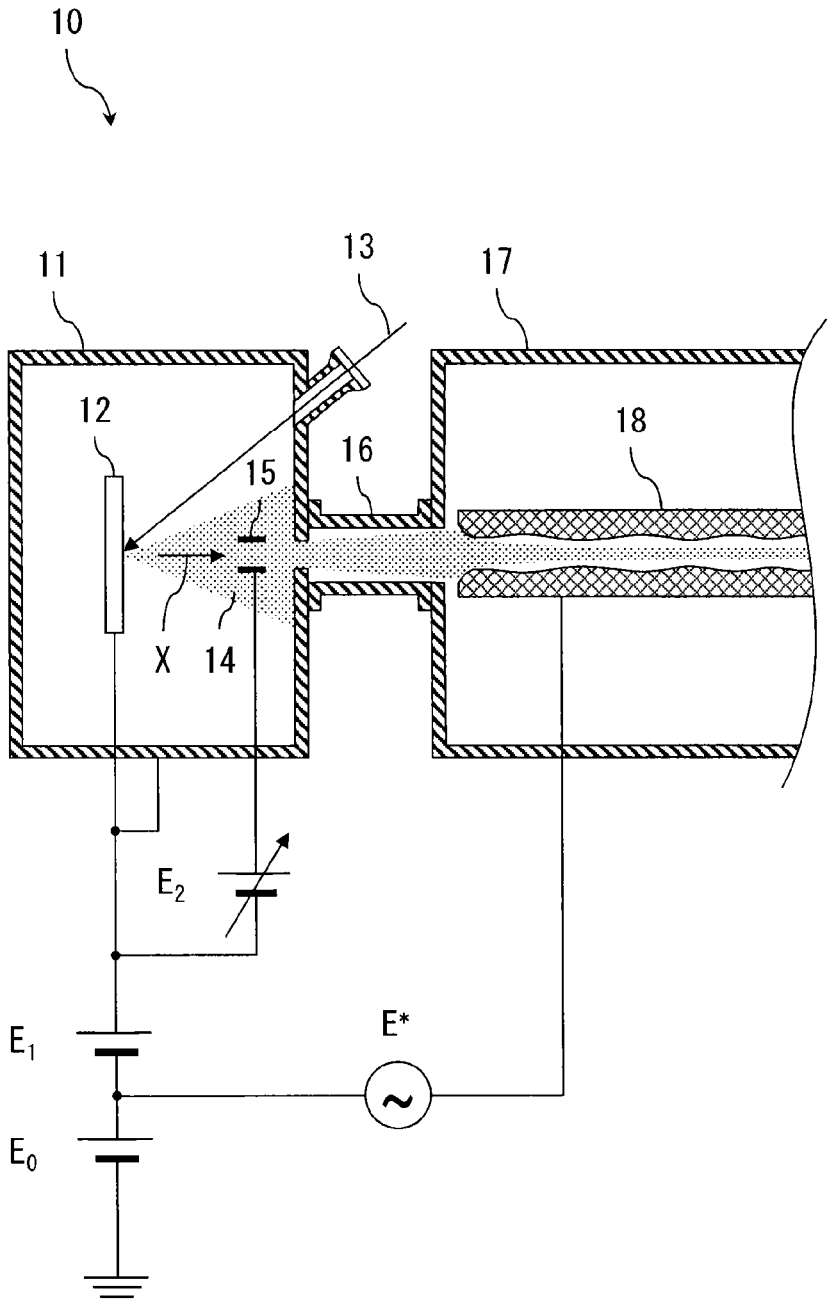
FIG. 1 is a block diagram showing a first embodiment of the ion source according to the present invention.

As shown in FIG. 1 an ion source 10 includes: a target 12 from which electron and positive ion are generated by plasma formed by laser 13 irradiation; a first power supply source (first voltage E1) that sets an electric potential of the target 12 higher than that of a destination of the positive ion (corresponding to an acceleration channel 18 in FIG. 1); and a second power supply source (second voltage E2) that sets an electric potential of on a path (corresponding to a filter electrode 15 in FIG. 1) from the target 12 to the destination 18 higher than that of the target 12.

An ionization chamber 11 accommodates the target 12 in evacuated internal space, the ionization chamber 11 having an electric potential set to the same electric potential as that of the target 12.

A laser irradiation member (not shown) is arranged outside of the ionization chamber 11. The laser 13 passing through a transparent window provided on the surface of the ionization chamber 11, and entering into the internal space to irradiate surface of the target 12. A condenser (not shown) is installed inside or outside of the ionization chamber 11. The laser 13 is condensed by the condenser before or after passing through the transparent window.

The element of the target 12 evaporates, ionizes, and then generating plasma 14 by the energy of the irradiated laser 13. The plasma 14 is in the state where the evaporated element of the target 12 ionizing into positive ion and electron, and become electrically neutral as a whole.

The plasma 14 contains impurities such as cluster ion with large mass and a positive ion with a low valence other than the desired polyvalent positive ion.

The positive ion in the plasma 14 has a larger initial velocity when it is emitted from the surface of the target 12 when the valence of the positive ion is higher or the mass thereof is smaller. The plasma 14 is emitted from the laser irradiating point and spread toward the beam direction X perpendicularly with the target.

The filter electrode 15 is provided on the path of the beam direction X from downstream side of the target 12 to upstream side of the linear accelerator 17. The form of the filter electrode 15 takes tubed shape, flat plate shape, etc., the form is not especially limited if having a passing mouth at the center for the positive ion.

The plasma 14 generated in the ion source 10 passes through the communicating path 16, and enters into the linear accelerator 17. The communicating path 16 is insulated electrically because electric potential differs between the ionization chamber 11 and the linear accelerator 17. Entering the plasma 14 into the linear accelerator 17, electron is separated, and the positive ion is accelerated in the acceleration channel 18.

In the power supply circuit shown in FIG. 1, the target 12 is applied the target voltage ($E_0$+$E_1$) in which first voltage $E_1$ was added to bias voltage $E_0$. The filter electrode 15 is applied the filter voltage ($E_0$+$E_1$+$E_2$) in which second voltage $E_2$ added to the target voltage ($E_0$+$E_1$). Meanwhile the bias voltage $E_0$ may be sufficient equal to 0V.

Cluster ions with large mass and low valence ions among the positive ions 14 contained in the plasma emitted from the target 12 cannot pass through the filter electrode 15 in the beam direction X due to their slow initial velocity. Thus disposing the filter electrode 15 on a path from the target 12 to the acceleration channel 18, the purity of the desired polyvalent positive ions outputted from the ion source 10 can be improved.

The ratio and quantity of the desired polyvalent positive ions outputted from the ion source 10 can be adjusted by adjusting the second voltage $E_2$.

The acceleration channel 18 is applied the accelerating voltage ($E_0$+E*) in which superimposing high-frequency-voltage E* on the bias voltage $E_0$.

Since the electric potential of entrance of the acceleration channel 18 is set low rather than that of the target 12 and the filter electrode 15. Thereby the polyvalent positive ion outputted from the ion source 10 adding speed rather than initial velocity and entering into the entrance of the acceleration channel 18.

Herewith the polyvalent positive ion entered into the acceleration channel 18 will be further accelerated.

Second Embodiment

Figure 2:
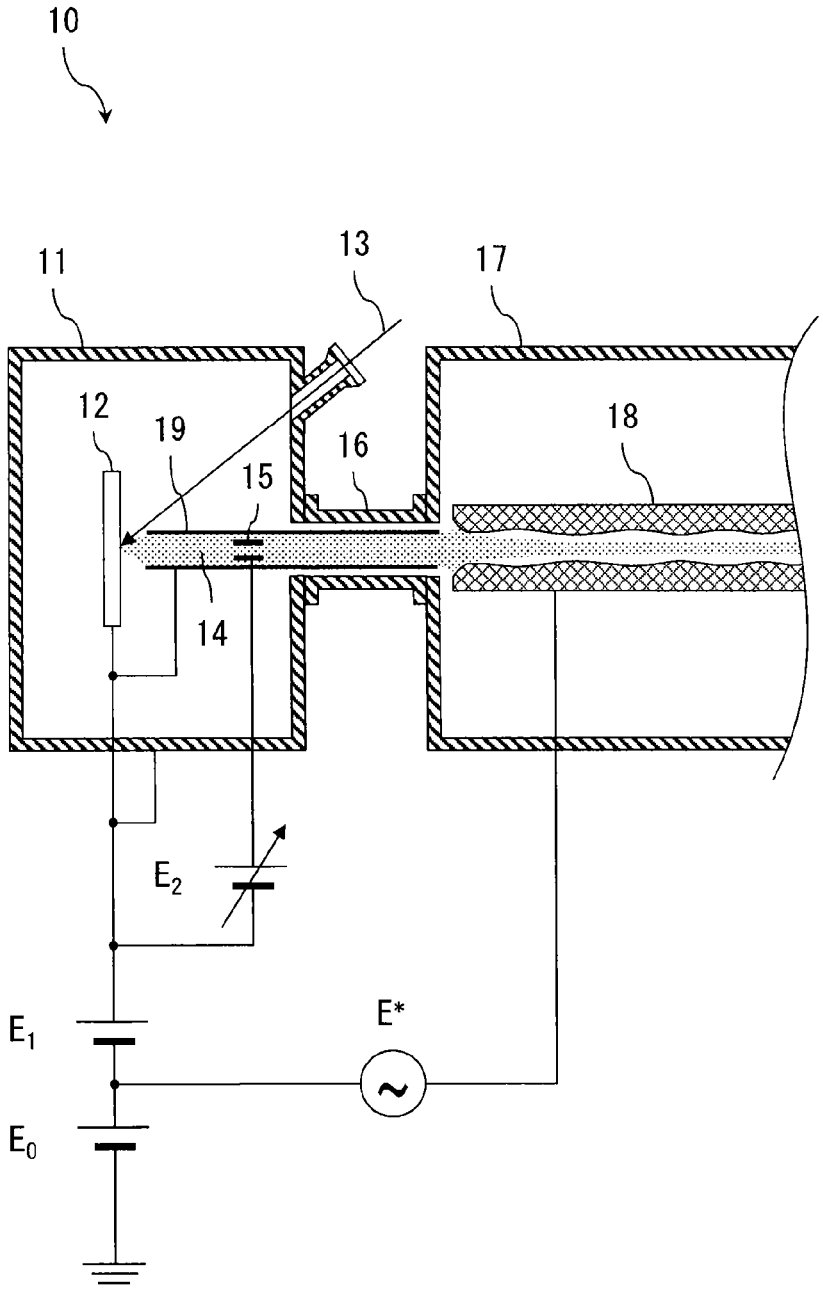
FIG. 2 is a block diagram showing a second embodiment of the ion source according to the present invention.

As shown in FIG. 2, the ion source 10 according to a second embodiment further includes a plasma transfer duct 19 having both end portions opened to the target 12 and the acceleration channel 18 respectively, the plasma transfer duct 19 having an electric potential set to a same electric potential as that of the target 12.

In addition, the same portion to which a mark is common with FIG. 1 and FIG. 2, overlapping explanation is omitted.

As the result of arranging the plasma transfer duct 19, the plasma generated from the target 12 can be led to the entrance of the acceleration channel 18 without spreading.

The filter electrode 15 is arranged on the path of the plasma transfer duct 19. Thereby the cluster ion with big mass and the low valence ion cannot pass the plasma transfer duct 19, the ion source 10 can output the polyvalent positive ion with high purity and with high efficient.

With reference to FIG. 3 effect of the present invention is described.

Figure 3A:
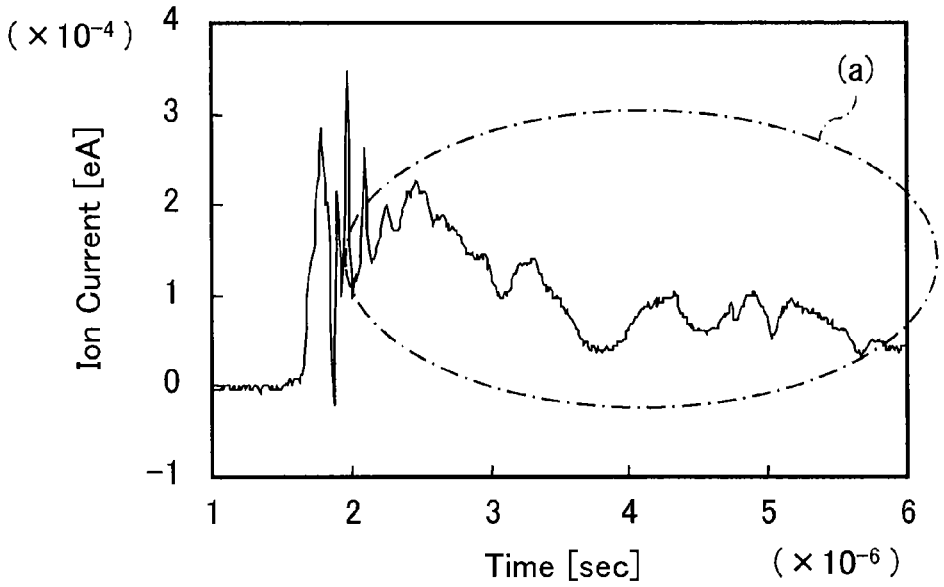
FIG. 3A is a graph showing the distribution of the ion current outputted from an ion source versus every valence of the ion when the second power supply source is set to 0 ($E_2$=0V).

FIG. 3A is a graph showing the distribution of the ion current outputted from an ion source 10 versus every valence of the ion under the condition of the second power supply source is set to 0 ($E_2$=0V).

Figure 3B:
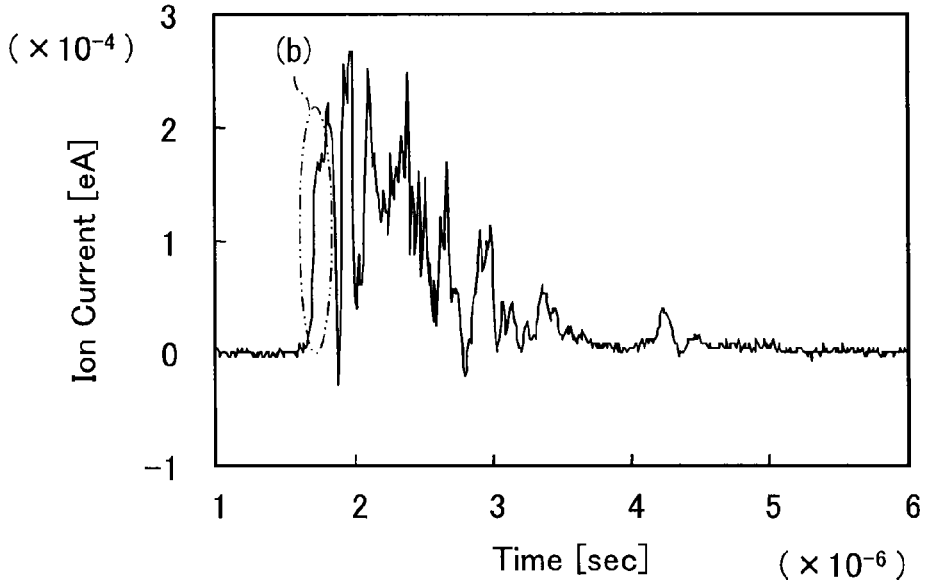
FIG. 3B is a graph showing the distribution of the ion current outputted from an ion source versus every valence of the ion when the second power supply source is operated.

FIG. 3B is a graph showing the distribution of the ion current outputted from an ion source versus every valence of the ion under the condition of the second power supply source is operated ($E_2 \neq 0$V).

The ion source 10 used for the experiment having the composition shown in the second embodiment, and the target 12 made of graphite. The property of the time of flight (TOF) of a carbon ion differs depending on the valence (+1 to +6). Based on such the property the graph shows the measurement value of the ion current for every valence of the ion. Note that the valence of ion becomes higher the time of flight (TOF) becomes shorter.

As shown in FIG. 3A, by setting out of the second voltage $E_2$=0, the ion current value of the low valence carbon ion is observed with high intensity as shown in region (a).

On the other hand, as shown in FIG. 3B, by setting out of second voltage $E_2 \neq 0$, the ion current value of the polyvalent carbon ion is observed with high intensity, as shown in region (b).

As mentioned above, at least one embodiment of the ion source 10, by setting electric potential of the filter electrode 15 disposed on a pass from the target 12 to the acceleration channel 18 higher than that of the target 12, the purity of the desired polyvalent positive ion outputted from the ion source 10 can be improved by confining the cluster ion with big mass and the low valence ion among the positive ions 14 in the ionization chamber 11.

While certain embodiments have been described, these embodiments have been presented by way of example only, and are not intended to limit the scope of the inventions. Indeed, the novel apparatus and method described herein may be embodied in a variety of other forms; furthermore, various omissions, substitutions and changes in the form of the apparatus and method described herein may be made without departing from the spirit of the inventions. The accompanying claims and their equivalents are intended to cover such forms or modifications as would fall within the scope and spirit of the inventions.

The invention claimed is:

1. An ion source, comprising:

a target from which plasma including electrons and positive ions is generated by laser irradiation;

a first power supply source that sets an electric potential of the target higher than that of an electric potential applied to an acceleration channel that accelerates the positive ions as they pass through the acceleration channel;

a filter electrode provided on a path of the plasma from the target to the acceleration channel;

a second power supply source that sets an electric potential of the filter electrode higher than the electric potential of the target;

an ionization chamber that accommodates the target and the filter electrode, and having an electric potential set to the same electric potential as that of the electric potential of the target; and a communicating path that connects the ionization chamber and a linear accelerator accommodating the acceleration channel, plasma passing through the communicating path after passing through the filter electrode.

2. The ion source according to claim 1, further comprising:

a plasma transfer duct having end portions opened respectively to the target and the acceleration channel, the plasma transfer duct having the electric potential of the target.

3. The ion source according to claim 1, wherein the second power supply source is configured to supply an adjustable voltage.

* * * * *